US009760041B2

(12) United States Patent
Omata et al.

(10) Patent No.: US 9,760,041 B2
(45) Date of Patent: Sep. 12, 2017

(54) IMAGE FORMING APPARATUS

(71) Applicant: CANON KABUSHIKI KAISHA, Tokyo (JP)

(72) Inventors: Haruhiko Omata, Abiko (JP); Akihiro Noguchi, Toride (JP); Tatsuomi Murayama, Abiko (JP); Yasuki Kamimori, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/194,862

(22) Filed: Jun. 28, 2016

(65) Prior Publication Data

US 2017/0003624 A1 Jan. 5, 2017

(30) Foreign Application Priority Data

Jul. 2, 2015 (JP) ..... 2015-133807

(51) Int. Cl.
*G03G 15/16* (2006.01)

(52) U.S. Cl.
CPC ..... *G03G 15/161* (2013.01); *G03G 15/168* (2013.01); *G03G 2215/00586* (2013.01); *G03G 2215/1661* (2013.01)

(58) Field of Classification Search
CPC .. G03G 15/161; G03G 15/168; G03G 15/158; G03G 2215/00586; G03G 2215/1661
USPC ..... 399/101
See application file for complete search history.

(56) References Cited

U.S. PATENT DOCUMENTS

| | | | | |
|---|---|---|---|---|
| 7,486,900 | B2 | 2/2009 | Omata | |
| 8,891,994 | B2 | 11/2014 | Tabata | |
| 9,046,865 | B2 * | 6/2015 | Sugiura | G03G 21/0035 |
| 2002/0044798 | A1 | 4/2002 | Katsumi et al. | |

(Continued)

FOREIGN PATENT DOCUMENTS

| | | | |
|---|---|---|---|
| JP | 2005-114802 | A | 4/2005 |
| JP | 2005-316102 | A | 11/2005 |

(Continued)

OTHER PUBLICATIONS

Search Report dated Dec. 16, 2016, in European Patent Application No. 16175627.5.
U.S. Appl. No. 15/190,348, filed Jun. 23, 2016.

*Primary Examiner* — Hoang Ngo
(74) *Attorney, Agent, or Firm* — Fitzpatrick, Cella, Harper & Scinto

(57) ABSTRACT

An image forming apparatus includes a movable intermediary transfer member, a toner image forming unit, a rotatable transfer member, a fixing unit, a recording material feeding portion, an executing portion, and first and second cleaning units. The first cleaning unit includes a first brush roller, a first rotatable member and a first blade member. The second cleaning unit includes a second brush roller, a second rotatable member, a second blade member and a third blade member. The third blade member is disposed downstream of the cleaning portion and upstream of a contact portion, between the second rotatable member and the second brush roller, with respect to a rotational direction of the second rotatable member, and scrapes a deposited matter off the second rotatable member with the rotation of the second rotatable member.

9 Claims, 4 Drawing Sheets

(56) References Cited

U.S. PATENT DOCUMENTS

| | | | | |
|---|---|---|---|---|
| 2007/0230994 | A1* | 10/2007 | Takishita | G03G 15/161 399/101 |
| 2007/0286621 | A1 | 12/2007 | Nishikawa | |
| 2011/0229187 | A1* | 9/2011 | Hozumi | G03G 15/161 399/101 |
| 2014/0037315 | A1 | 2/2014 | Tabata | |
| 2014/0064769 | A1 | 3/2014 | Sugiura | |
| 2016/0091832 | A1 | 3/2016 | Omata et al. | |

FOREIGN PATENT DOCUMENTS

| | | | |
|---|---|---|---|
| JP | 2007-057610 | A | 3/2007 |
| JP | 2013-007796 | A | 1/2013 |
| JP | 2013-195559 | A | 9/2013 |
| JP | 2013-221951 | A | 10/2013 |
| JP | 2014-006289 | A | 1/2014 |

* cited by examiner

IMAGE FORMING APPARATUS

FIELD OF THE INVENTION AND RELATED ART

The present invention relates to an image forming apparatus for forming an image on a recording material with the use of an electrophotographic method (type) or the like.

Conventionally, there has been known an image forming apparatus of an intermediary transfer type in which a toner image formed on a photosensitive drum is primary-transferred onto an intermediary transfer belt, and then, is secondary-transferred onto a recording material at a transfer nip formed between a secondary transfer belt and the intermediary transfer belt. In this image forming apparatus, a transfer residual toner remaining on the photosensitive drum without being transferred during the transfer process, a toner of the toner image which is not transferred onto the material due to generating of a jam, and a part of a patch toner image or the like formed for adjusting a toner (image) density can be deposited on the toner band and the secondary transfer belt. Therefore, for example, in order to remove the toner deposited on the secondary transfer belt, the image forming apparatus is provided with a cleaning device of an electrostatic type. In Japanese Laid-Open Patent Application (JP-A) 2005-316102, in the cleaning device of the electrostatic type, the secondary transfer belt is rubbed with two fur brushes at upstream and downstream positions with respect to a rotational direction of the secondary transfer belt, and one of these fur brushes is charged to an opposite polarity to a charge polarity of the toner and the other fur brush is charged to an identical polarity to the charge polarity of the toner, and thus the toners are attracted to the fur brushes. In this case, the toner attracted to each of the fur brushes is moved to a metal roller rubbing against the fur brush, and then is mechanically scraped off the fur brush by a cleaning blade contacting the metal roller.

In image forming apparatuses in recent years, in order to fix a toner (image) onto the recording material even at a low temperature, a toner contains a wax that melts at the low temperature. In the case where images are formed on two (both) sides of the recording material with this toner, the recording material after an end of the image formation on a first surface (front surface) is heated for fixing the toner (image) thereon and thus has heat, and therefore is in a state in which the melted wax bleeds from the recording material. When the recording material on which the wax bleeds therefrom is turned upside down and then is subjected to subsequent image formation on a second surface (back surface), the wax can be deposited on a secondary transfer belt by being moved from the first surface (front surface) of the recording material onto the secondary transfer belt. Then, the wax deposited on the secondary transfer belt is deposited on the metal roller through the fur brush, and therefore, the wax is scraped off the metal roller by the cleaning blade.

However, the cleaning blade cannot completely remove all of the waxes. The wax passing through the cleaning blade without being scraped off the metal roller by the cleaning blade stagnates and grows by being deposited in a blade side at a contact portion (blade contact nip) where a free end of the cleaning blade contacts the metal roller, so that the wax is liable to become a lump of wax. When the lump of wax generates, the blade contact portion is raised by the lump of wax and does not readily contact the metal roller, so that the toner is liable to pass through the cleaning blade, and therefore, the lump of wax causes improper cleaning (cleaning failure) of the toner. Therefore, JP-A 2013-7796 has disclosed a device in which a wax is melted by heating a secondary transfer belt and the melted wax is collected from the secondary transfer belt, and thus the improper cleaning of the toner due to the lump of wax is prevented.

The device capable of collecting the wax by heating the wax as described above has a complicated structure, so that a cost is liable to be expensive. Therefore, as a method by which the above-described lump of wax does not readily generate, it would be considered that a toner is supplied to the cleaning blade via the fur brush and the metal roller. However, in this case, the toner is supplied in a large amount to the cleaning blade contacting the metal roller to which a voltage of an opposite polarity to a charge polarity of the toner is applied, but is not much supplied to the cleaning blade contacting the metal roller to which a voltage of an identical polarity to the charge polarity of the toner is applied. For that reason, in a metal roller side where the voltage of the identical polarity to the charge polarity of the toner is applied, the lump of wax generates at the contact portion (blade contact nip), so that the improper cleaning of the toner is liable to generate.

SUMMARY OF THE INVENTION

According to an aspect of the present invention, there is provided an image forming apparatus comprising: a movable intermediary transfer member; a toner image forming unit configured to form a toner image on the intermediary transfer member with a toner containing a wax; a rotatable transfer member configured to form a transfer portion in contact with the intermediary transfer member, wherein in the transfer portion, a transfer electric field for transferring the toner image from the intermediary transfer member onto a recording material fed to the transfer portion; a fixing unit configured to fix the toner image on the recording material by heating the recording material, on which the toner image is transferred, together with the toner image at the transfer portion; a feeding portion configured to feed to the transfer portion the recording material after passing through the fixing unit, wherein the feeding unit feeds the recording material so that a toner image-fixed surface of the recording material faces toward the rotatable transfer member at the transfer portion; an executing portion configured to execute double-sided image formation for forming the toner image on one surface of the recording material and then for forming a toner image on the other surface of the recording material by feeding the recording material by the feeding portion; and first and second cleaning units configured to electrostatically remove the toner on the rotatable transfer member, wherein the first cleaning unit includes a first brush roller, a first rotatable member and a first blade member, wherein the second cleaning unit includes a second brush roller, a second rotatable member, a second blade member and a third blade member, wherein each of the first and second brush rollers has electroconductivity and electrostatically attracts the toner on the rotatable transfer member in contact with the rotatable transfer member while being rotated, wherein a voltage of an opposite polarity to a normal charge polarity of the toner is applied to the first rotatable member, and the toner attracted to the first brush roller in contact with the first brush roller is electrostatically attracted to the first rotatable member, wherein a voltage of an identical polarity to the normal charge polarity of the toner is applied to the second rotatable member, and the toner attracted to the second brush roller in contact with the second brush roller at a contact position is electrostatically attracted to the second rotatable member, wherein the first blade member contacts the first rotatable member and scrapes a deposited matter off the first rotatable member with rotation of the first rotatable member, wherein the second blade member contacts the second rotatable member at a cleaning portion and scrapes a deposited matter off the second rotatable member with rotation of the second rotatable member, and wherein the third blade member is disposed downstream of the cleaning portion and upstream of the contact position with respect to a rotational direction of the second rotatable member, and scrapes the deposited matter off the second rotatable member with the rotation of the second rotatable member.

According to another aspect of the present invention, there is provided an image forming apparatus comprising: a movable intermediary transfer member; a toner image forming unit configured to form a toner image on the intermediary transfer member with a toner containing a wax; a rotatable transfer member configured to form a transfer portion in contact with the intermediary transfer member, wherein in the transfer portion, a transfer electric field for transferring the toner image from the intermediary transfer member onto a recording material fed to the transfer portion; a fixing unit configured to fix the toner image on the recording material by heating the recording material, on which the toner image is transferred, together with the toner image at the transfer portion; a feeding portion configured to feed to the transfer portion the recording material after passing through the fixing unit, wherein the feeding unit feeds the recording material so that a toner image-fixed surface of the recording material faces toward the rotatable transfer member at the transfer portion; an executing portion configured to execute double-sided image formation for forming the toner image on one surface of the recording material and then for forming a toner image on the other surface of the recording material by feeding the recording material by the feeding portion; and first and second cleaning units configured to electrostatically remove the toner on the rotatable transfer member, wherein the first cleaning unit includes a first brush roller, a first rotatable member and a first blade member, wherein the second cleaning unit includes a second brush roller, a second rotatable member, a second blade member and a third blade member, wherein each of the first and second brush rollers has electroconductivity and electrostatically attracts the toner on the intermediary transfer member in contact with the intermediary transfer member while being rotated, wherein a voltage of an opposite polarity to a normal charge polarity of the toner is applied to the first rotatable member, and the toner attracted to the first brush roller in contact with the first brush roller is electrostatically attracted to the first rotatable member, wherein a voltage of an identical polarity to the normal charge polarity of the toner is applied to the second rotatable member, and the toner attracted to the second brush roller in contact with the second brush roller at a contact position is electrostatically attracted to the second rotatable member, wherein the first blade member contacts the first rotatable member and scrapes a deposited matter off the first rotatable member with rotation of the first rotatable member, wherein the second blade member contacts the second rotatable member at a cleaning portion and scrapes a deposited matter off the second rotatable member with rotation of the second rotatable member, and wherein the third blade member is disposed downstream of the cleaning portion and upstream of the contact position with respect to a rotational direction of the second rotatable member, and scrapes the deposited matter off the second rotatable member with the rotation of the second rotatable member.

Further features of the present invention will become apparent from the following description of exemplary embodiments (with reference to the attached drawings).

DESCRIPTION OF THE EMBODIMENTS

Embodiment 1

Figure 1:
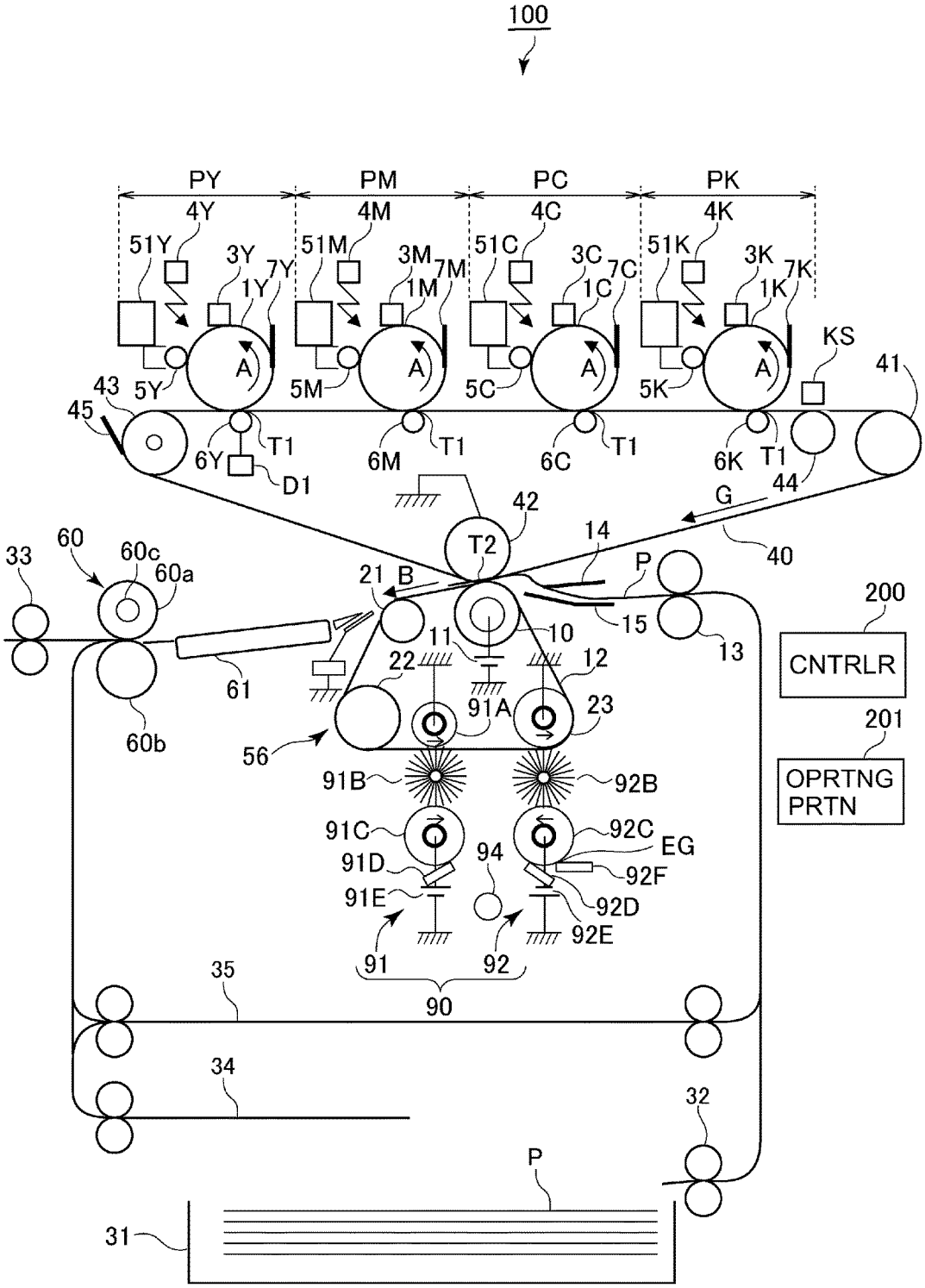
FIG. 1 is a schematic view showing a structure of an image forming apparatus in a First Embodiment.
Figure 2:
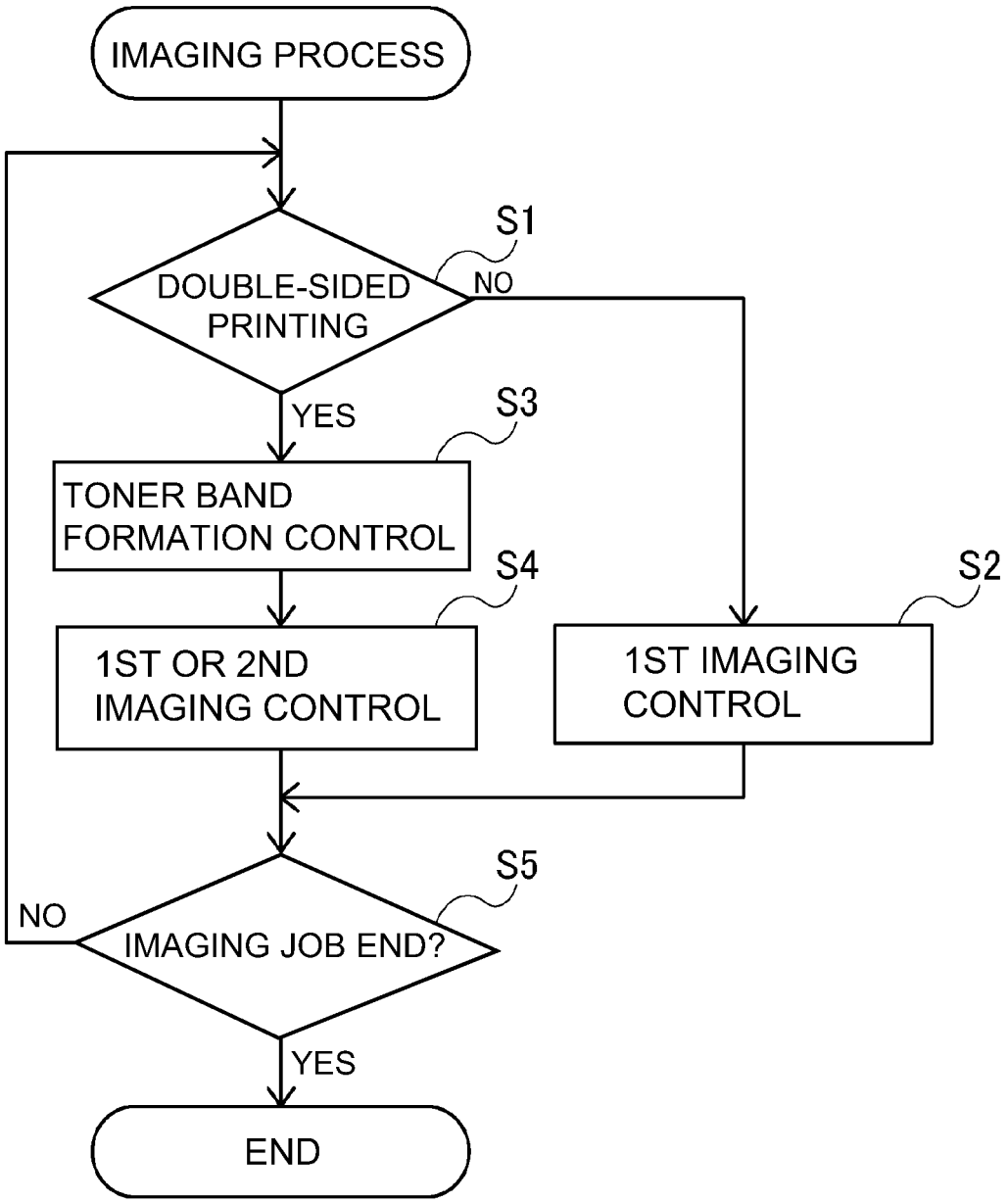
FIG. 2 is a flowchart showing an image forming process.
Figure 3:
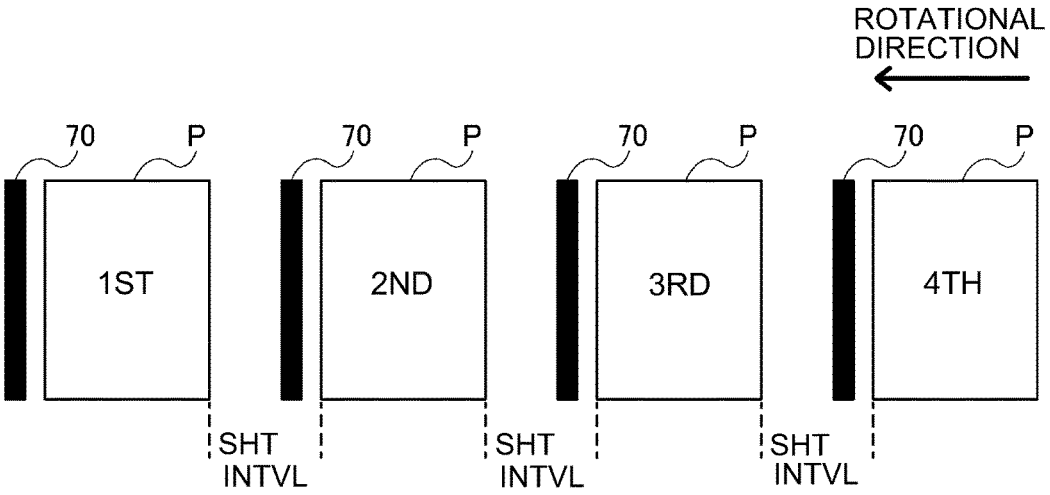
FIG. 3 is a schematic view showing a toner band formed on a secondary transfer belt.

Referring to FIGS. 1-3, the First Embodiment of the present invention will be described. To begin with, referring to FIG. 1, an image forming apparatus in this embodiment will be described.

An image forming apparatus 100 is a full-color printer of a tandem type and of an intermediary transfer type, in which yellow, magenta, cyan and black image forming portions PY, PM, PC and PK are arranged along an intermediary transfer belt 40.

In this image forming portion PY, a yellow toner image is formed on a photosensitive drum 1Y and is primary-transferred onto the intermediary transfer belt 40. In the image forming portion PM, a magenta toner image is formed on a photosensitive drum 1M and is primary-transferred superposedly onto the yellow toner image on the intermediary transfer belt 40. In the image forming portions PC and PK, cyan and black toner images are formed on photosensitive drums 1C and 1K, respectively, and are sequentially transferred superposedly onto the yellow and magenta toner images on the intermediary transfer belt 40. The intermediary transfer belt 40 rotates while carrying the toner images.

A recording material P is taken out from a recording material cassette 31 by a pick-up roller 32 and is sent to a registration roller pair 13. The registration roller pair 13 sends the recording material P to a secondary transfer portion T2 by timing the recording material P to the toner images on the intermediary transfer belt 40. The recording material P on which the four color toner images are secondary-transferred is sent to a fixing device 60, in which the recording material P is subjected to heat and pressure by a heating roller 60*a* and a pressing roller 60*b* which are used as heating means. As a result, the toner images on the recording material P are heated and fixed on the recording material P.

<Image Forming Portion>

The image forming portions PX, PM, PC and PK are substantially the same in structure except that they are different in the color (yellow, magenta, cyan and black, respectively) of the toners they use. Therefore, in the following, the image forming portion PY will be described in detail, and as regards to the image forming portions PM, PC and PK, constituent elements thereof will be described by reading the suffixes Y of symbols as M, C and K, respectively.

The image forming portion PY includes, around the photosensitive drum 1Y, a charging device 3Y, an exposure device 4Y, a developing device 5Y, a primary transfer roller 6Y, and a drum cleaning device 7Y. The photosensitive drum 1Y as an image bearing memory is a drum-shaped electrophotographic photosensitive memory which is rotatably supported, and is rotated by an unshown photosensitive drum driving motor at a predetermined process speed in the counterclockwise direction (indicated by arrow A in FIG. 1).

The charging device 3Y uniformly charges the surface of the photosensitive drum 1Y, by being supplied with an oscillating voltage in the form of a negative DC voltage biased with an AC voltage, so that the charging device 3Y charges the surface of the photosensitive drum 4Y to a uniform negative dark portion potential. The exposure device 4Y writes (forms) an electrostatic latent image on the charged surface of the photosensitive drum 1Y by scanning, through a rotating mirror, the surface of the photosensitive drum 1Y with a laser beam obtained by ON-OFF modulating scanning line image data developed from separated color images of the respective colors.

The developing device 5Y develops the electrostatic latent image into a toner image by supplying a toner, charged to a negative polarity which is a normal charge polarity as a first polarity, to the photosensitive drum 1Y. In the developing device 5Y, an unshown developing sleeve disposed with a slight gap from the surface of the photosensitive drum 1Y is rotated counterdirectionally to the photosensitive drum 1Y. The developing device 5Y charges a two-component developer containing a toner and a carrier, and conveys the developer to an opposing portion of the photosensitive drum 1Y while carrying the developer on the developing sleeve. The oscillating voltage (developing voltage) in the form of a DC voltage biased with an AC voltage is applied to the developing sleeve, so that the negatively charged toner is moved to an exposed portion of the photosensitive drum 1Y which is positive relative to the negatively charged toner, and thus the electrostatic latent image is developed reversely. A developer supplying portion 51Y supplies a developer for supply to the developing device 5Y depending on toner consumption with image formation.

The primary transfer roller 6Y forms the primary transferring portion T1 between the photosensitive drum 1Y and the intermediary transfer belt 40 by pressing the intermediary transfer belt 40. A primary transfer high-voltage (power) source D1 is connected to, and applies a primary transfer bias (voltage) of the positive polarity to, the primary transfer roller 6Y, whereby the negatively charged toner image on the photosensitive drum 1Y is transferred onto the intermediary transfer belt 40. Incidentally, in FIG. 1, the primary transfer high-voltage source D1 is connected to only the primary transfer roller 6Y, but is similarly connected to other primary transfer rollers 6M, 6Y and 6C.

The drum cleaning device 7Y contacts the photosensitive drum 1Y and removes, from the photosensitive drum 1Y, the toner and the like which passed through the primary transfer portion T1 and which are deposited on the photosensitive drum 1Y.

<Intermediary Transfer Belt>

The intermediary transfer belt 40 is an intermediary transfer member rotatable in contact with the photosensitive drum 1Y. The intermediary transfer belt 40 is supported by being extended around a tension roller 41, an inner secondary transfer roller 42 and a driving roller 43, and is driven by the driving roller 43 and thus rotates in an arrow G direction in the figure at a rotational speed of 250-300 mm/sec, for example. The tension roller 41 stretches the intermediary transfer belt 40 with a certain tension.

The intermediary transfer belt 40 is formed in an endless belt shape in which on a core metal as a substrate, in the order from the core metal side, a resin layer, an elastic layer and a surface layer are laminated. The resin layer uses, e.g., a resin material such as polyimide or polycarbonate, and is formed in a thickness of 70-100 μm. The elastic layer uses, e.g., an elastic material such as urethane rubber or chloroprene rubber, and is formed in a thickness of 120-180 μm. The surface layer requires a small toner depositing force for facilitating transfer of the toner from the intermediary transfer belt 40 onto the recording material P at the secondary transfer portion T2. For that reason, the surface layer uses, e.g., one species of resin materials such as polyurethane, polyester and epoxy resin, or two or more species of elastic materials such as an elastic material rubber, elastomer and butyl rubber. Further, in order to enhance a lubricating property by decreasing surface energy, in the surface layer, one species or two or more species of, e.g., powder or particles of a fluorine-containing resin or the like, or powder or particles different in particle size and dispersed. The surface layer is formed in a thickness of 5-10 μm. Incidentally, the intermediary transfer belt 40 is adjusted so that a volume resistivity is, e.g., $10^9$ Ω·cm.

The four color toner images transferred onto the intermediary transfer belt 40 are conveyed to the secondary transferring portion T2, and are secondary-transferred together onto the recording material P (a sheet material such as paper, OHP film or the like). A cleaning blade 45 as an intermediary transfer belt cleaning device contacts the intermediary transfer belt 40 and removes, from the intermediary transfer belt 40, a deposited matter such as the toner deposited on the intermediary transfer belt 40 after the secondary transfer. The cleaning blade 45 is contacted to the intermediary transfer belt 45 counterdirectionally with respect to the rotational direction (arrow G direction in the figure) of the intermediary transfer belt 40, and mechanically scrapes the deposited matter such as the toner off the intermediary transfer belt 40.

<Secondary Transfer Belt Unit>

A secondary transfer belt unit 56 causes the secondary transfer belt 12 as a rotatable secondary transfer member to pass through the secondary transfer portion T2 by causing the secondary transfer belt 12 to carry the recording material P. Using the secondary transfer belt 12, after the secondary transfer of the toner image at the secondary transfer portion T2, separation of the recording material P from the intermediary transfer belt 40 is facilitated.

The secondary transfer belt unit 56 includes the secondary transfer belt 12, an outer secondary transfer roller 10, a separation roller 21, a tension roller 22 and a driving roller 23. The secondary transfer belt 12 forms the secondary transfer portion T2 is contact with the intermediary transfer belt 40. A transfer electric field is generated at the secondary transfer portion T2, so that the toner image carried on the intermediary transfer belt 40 is transferred onto the recording material P. Further, in this embodiment, in order to supply toners to cleaning blades 91D and 92D, a band-shaped supply toner image to be carried on the intermediary transfer belt 40 is transferred onto the secondary transfer belt 12.

The secondary transfer belt 12 is formed in an endless belt shape by using a high-resistant resin material and is stretched by the outer secondary transfer roller 10, the separation roller 21, the tension roller 22 and the driving roller 23. The secondary transfer belt 12 rotates in an arrow B direction in the figure at, e.g., 300 mm/sec in synchronism with the intermediary transfer belt 40, and feeds the recording material P to the fixing device 60 by causing the recording material P fed by the registration roller pair 13 to pass through the secondary transfer portion T2. The secondary transfer belt 12 feeds the recording material P in close contact with the recording material P by being charged when the toner image carried on the intermediary transfer belt 40 is transferred onto the recording material P, and separates the recording material P, on which the toner image is transferred, from the intermediary transfer belt 40 and then feeds the recording material P toward the fixing device 60.

The secondary transfer belt 12 is the endless belt formed using a resin material, such as polyimide or polyamide, in which carbon black as an antistatic agent is contained in an appropriate amount. The secondary transfer belt 12 is adjusted so that a volume resistivity is $10^9$-$10^{14}$ Ω·cm. Further, the secondary transfer belt 12 is formed in a thickness of 0.07-0.1 mm. Further, the secondary transfer belt 12 has Young's modulus of not less than 100 MPa and less than 10 GPa as measured by a tensile testing method (JIS K 6301).

The outer secondary transfer roller 10 is press-contacted to the secondary transfer belt 12 toward the intermediary transfer belt 40 and the inner secondary transfer roller 42, and forms the secondary transfer portion T2 between the intermediary transfer belt 40 and the secondary transfer belt 12. To the outer secondary transfer roller 10, a secondary transfer high-voltage source 11 capable of variably changing a bias voltage is attached. In the secondary transfer high-voltage source 11, the bias voltage is subjected to constant-current control so that a transfer current of +40-+60 μA flows. The transfer electric field is generated at the secondary transfer portion T2 by applying a bias voltage (secondary transfer voltage) of the positive polarity opposite to the charge polarity of the toner from the secondary transfer high-voltage source 11 to the outer secondary transfer roller 10 while connecting the inner secondary transfer roller 42 to the grounding potential (0 V). In response to this transfer electric field, the negative(-polarity) toner images of yellow, magenta, cyan and black carried on the intermediary transfer belt 40 are secondary-transferred onto the recording material P or the secondary transfer belt 12.

The outer secondary transfer roller 10 is formed by laminating an elastic layer of an ion-conductive foamed rubber (NBR rubber) on a core metal as a substrate. The outer secondary transfer roller 10 is formed in an outer diameter of, e.g., 24 mm. The elastic layer is 6.0-12.0 μm in surface roughness Rz and is about 30-40 in Asker-C hardness. Further, the elastic layer is $10^5$-$10^7$Ω in electrical resistance value as measured under application of a voltage of 2 kV in a normal temperature/normal humidity (N/N) environment (23° C./50% RH).

The separation roller 21 separates the recording material P from the secondary transfer belt 12 at a position downstream of the secondary transfer portion T2 with respect to the rotational direction of the secondary transfer belt 12. Specifically, after the recording material P on the secondary transfer belt 12 reaches the separation roller 21, the recording material P is curvature-separated from the secondary transfer belt 12 by a curved surface of the secondary transfer belt 12 along a peripheral surface of the separation roller 21.

The driving roller 23 is connected to an unshown driving motor and is rotated in an arrow B direction in the figure by driving the secondary transfer belt 12. The tension roller 22 includes an unshown urging (pressing) spring and urges the secondary transfer belt 12 from an inside toward an outside by an urging force of this urging spring, so that a predetermined tension is applied to the secondary transfer belt 12.

The recording material P curvature-separated from the secondary transfer belt 12 is conveyed by a conveying belt 61 and sent into the fixing device 60. The recording material P on which the toner image is fixed by the fixing device 60 is discharged to an outside of the image forming apparatus 100. However, where the recording material P is conveyed after the fixation of the toner images in a one-sided printing mode in which an image is formed on only a first surface (front surface) of the recording material P, is different from where the recording material P is conveyed after the fixation of the toner images in a double (two)-sided printing mode in which an image is formed on both surfaces of the recording material P.

In the one-sided printing mode, the recording material P which passed through the fixing device 60 is discharged to an outside of the image forming apparatus as-is through a discharging roller pair 33. On the other hand, in the double-sided printing mode, the recording material P on which the toner images are transferred passes through a reversal feeding pass 34 and a feeding pass 35 for double sided printing which are used as feeding portions, and then is fed again to the secondary transfer portion T2 so that the second surface (back surface), which is the opposite surface from the first surface, is an image forming surface, i.e., so that the recording material P is turned upside down. Specifically, the recording material P passed through the fixing device 60 is sent into the reversal feeding pass 34 and then is subjected to a switch-back operation in the reversal feeding pass 34, so that a leading end and a trailing end of the recording material P are changed to each other and then the recording material P is fed to the feeding pass 35 for the double sided printing. The feeding pass 35 for the double sided printing sends the recording material P to the secondary transferring portion T2 again by merging the recording material P with the registration roller pair 13. In this case, the recording material P is, after the toner image is secondary-transferred onto also the second surface (back surface) and is fixed thereon, discharged to the outside of the image forming apparatus through the discharging roller pair 33.

In the image forming apparatus 100, during a continuous image forming job, the toner images to be transferred onto the recording material P are formed on the intermediary transfer belt 40, but patch toner images of the respective colors are formed on the intermediary transfer belt 40 with predetermined sheet intervals. Densities of the patch toner images formed on the intermediary transfer belt 40 are measured by an optical sensor KS. Then, the measured densities are fed back to control for controlling various operations. The control to which the densities of the patch toner images are fed back includes, e.g., setting of a laser power of the exposure device 4Y, setting of the developing voltage of the developing device 5Y, adjustment of a toner supply amount to the developer supplying portion 51Y. When the patch toner images pass through the secondary transfer portion T2, the intermediary transfer belt 40 and the secondary transfer belt 12 are pressed in close contact with each other, and therefore a part of the toners of the patch toner images can move from the intermediary transfer belt 40 to the secondary transfer belt 12.

Further, in the case where the recording material P is jammed in the reversal feeding path 34, the feeding path 35 for the double sided printing or the like (in the case of a so-called jam), even when the recording material P is removed from the feeding path, the toner images which are not transferred onto the recording material P can remain on the intermediary transfer belt 40. In that case, when the image forming apparatus is actuated again after jam clearance, a part of the toners of the toner images remaining on the intermediary transfer belt 40 is deposited on the secondary transfer belt 12. The toners deposited on the secondary transfer belt 12 causes generation of an image defect, and therefore there is a need to remove the toners. For that reason, the image forming apparatus 100 is provided with a secondary transfer belt cleaning device 90 of an electrostatic type.

<Secondary Transfer Belt Cleaning Device>

The secondary transfer belt cleaning device 90 removes, from the secondary transfer belt 12, the toners deposited on the secondary transfer belt 12. Specifically, after the toner charged to the negative polarity (first polarity) which is a normal charge polarity of the toner is removed using a fur brush 91B to which a bias voltage of the positive polarity (second polarity) is applied, the toner charged to the photosensitive drum is removed using a fur brush 92B to which a bias voltage of the negative polarity is applied. In this embodiment, the fur brush 91B rubs against the secondary transfer belt 12 in an upstream side with respect to the rotational direction of the secondary transfer belt 12, and the fur brush 92B rubs against the secondary transfer belt 12 in a downstream side with respect to the rotational direction of the secondary transfer belt 12.

The secondary transfer belt cleaning device 90 includes a first cleaning portion 91 and a second cleaning portion 92. The first cleaning portion 91 includes the fur brush 91B as a first fur brush, a metal roller 91C as a first rotatable member, a voltage (power) source 91E and a cleaning blade 91D as a first blade. The second cleaning portion 92 includes the fur brush 92B as a second fur brush, a metal roller 92C as a second rotatable member, a voltage source 92E, a cleaning blade 92D as a second blade and a cleaning blade 92F as a third blade. The fur brushes 91B and 92B and the metal rollers 91C and 92C are connected by an unshown gear mechanism and are rotated by an unshown driving motor. The fur brushes 91B and 92B rotate in an opposite direction to the rotational direction of the secondary transfer belt 12 at contact positions in contacted states with the secondary transfer belt 12, respectively, and rub against the secondary transfer belt 12. The fur brush 92B rubs against the peripheral surface of the secondary transfer belt 12 after the fur brush 91B rubs against the peripheral surface of the secondary transfer belt 12. Each of these fur brushes 91B and 92B is prepared by planting electroconductive nylon fibers of $10^5$ Ω·cm in volume resistivity, and is formed in a diameter of, e.g., 18 mm. Then, the fur brush is disposed so that a penetration depth (amount) thereof into the secondary transfer belt 12 is, e.g., 1.5 mm.

Further, the fur brushes 91B and 92B rub against the metal rollers 91C and 92C, respectively. The fur brush 91B rubs against the metal roller 91C in the contacted state with the metal roller 91C by being rotated codirectionally with the rotational direction of the metal roller 91C at the contact position. The fur brush 92B rubs against the metal roller 92C in the contacted state with the metal roller 92C by being rotated counterdirectionally with the rotational direction of the metal roller 92C at the contact position. Each of the metal rollers 91C and 92C is formed in a diameter of, e.g., 20 mm. Further, the metal rollers 91C and 92C are disposed so that their penetration depths into the fur brushes 91B and 92B, respectively, are, e.g., 2 mm.

A supporting roller 91A is grounded to the ground potential (0 V), and supports the secondary transfer belt 12, against which the fur brush 91B rubs, from an inner peripheral surface side, and is rotated by the secondary transfer belt 12. The supporting roller 91A is a cylindrical roller and is formed in a diameter of, e.g., 13 mm. The driving roller 23 is connected to the ground potential (0 V) and supports the secondary transfer belt 12, against which the fur brush 92B rubs, from the inner peripheral surface side of the secondary transfer belt 12, and rotationally drives the secondary transfer belt 12 as described above. The driving roller 23 is formed in a diameter of, e.g., 25 mm by coating an outer peripheral surface thereof with, e.g., a 0.5 mm-thick electroconductive rubber of $10^5$ Ω·cm in volume resistivity.

The voltage source 91E generates an electric field between the fur brush 91B and the supporting roller 91A by applying a voltage of the positive polarity (second polarity) to the metal roller 91C. As a result, the fur brush 91B rubbing against the metal roller 91C is charged to the positive polarity and thus is capable of attracting the toner which is deposited on the secondary transfer belt 12 and which is charged to the negative polarity (first polarity). The toner attracted to the fur brush 91B is moved to the metal roller 91C higher in potential of the positive polarity, and then is scraped off by the cleaning blade 91D. The cleaning blade 91D contacts the metal roller 91C counterdirectionally to the rotational direction of the metal roller 91C and scrapes the toner off the metal roller 91C (first rotatable member). The toner scraped off by the cleaning blade 91D is fed to a residual (waste) toner box by a residual toner feeding screw 94.

On the other hand, the voltage source 92E generates an electric field between the fur brush 92B and the driving roller 23 by applying a voltage of the negative polarity (first polarity) to the metal roller 92C. As a result, the fur brush 92B rubbing against the metal roller 92C is charged to the negative polarity. A part of the toner attracted to the above-described fur brush 91B rotates together with the fur brush 91B without being moved to the metal roller 91C. Then, the toner which is not moved to the metal roller 91C is changed in charge polarity from the negative polarity to the positive polarity. The toner changed in charge polarity to the positive polarity is moved back from the fur brush 91B to the secondary transfer belt 12, and thereafter is attracted to the fur brush 92B. The toner attracted to the fur brush 92B is moved to the metal roller 92C higher in potential of the negative polarity, and then is scraped off the metal roller 92C (second rotatable member) by the cleaning blade 92D. The cleaning blade 92D contacts the metal roller 92C counterdirectionally to the rotational direction of the metal roller 92C and removes the toner from the metal roller 92C. The toner scraped off by the cleaning blade 92D is fed to the residual toner box by the residual toner feeding screw 94. These cleaning blades 91D and 92D are rubber blades formed in a plate shape. In this embodiment, the toners are capable of being supplied in a large amount to the secondary transfer belt cleaning device 90, and therefore, it is particularly preferable that a rubber blade high in cleaning performance is used as the cleaning blade 91D. For example, an urethane rubber-made rubber blade of less than 200 MPa in Young's modulus and about 60-90, preferably about 70-80, in Asker-C hardness may preferably be used. The cleaning blade 92D may be the same as the cleaning blade 91D.

The cleaning blades 91D and 92D not only scrape the toner off the metal rollers 91C and 92C but also are capable of scraping the waxes deposited on the metal rollers 91C and 92C via the fur brushes 91B and 92B. However, different from the toners, the waxes have adhesiveness, and therefore the waxes which cannot be removed and which passed through the cleaning blades are liable to accumulate and deposit at contact portions (blade contact nips) of the cleaning blades 91D and 92D. For that reason, a wax deposition amount can increase with an increasing number of sheets of the recording material P subjected to the image formation in the double sided printing. Then, when a height of the deposited wax reaches a height where the wax is capable of passing through the cleaning blades, improper cleaning (removal) of the toners can generate. Therefore, in this embodiment, as described later, supply toner images (hereinafter referred to as toner bands) are formed on the secondary transfer belt 12, so that the toners are supplied to the cleaning blades 91D and 92D via the fur brushes 91B and 92B and the metal rollers 91C and 92C. By supplying the toners, lumps of waxes are prevented from generating at the contact portions of the cleaning blades 91D and 92D.

However, in the case of the above-described secondary transfer belt cleaning device 90, most of the toner bands formed on the secondary transfer belt 12 are supplied to the first cleaning portion 91 and therefore are minimally supplied to the second cleaning portion 92. For that reason, the lump of wax generates at the contact portion of the cleaning blade 92D, so that the toner is liable to pass through the cleaning blade 92D.

Therefore, in this embodiment, with respect to the metal roller 92C of the second cleaning portion 92, a second cleaning blade 92F is provided downstream of the cleaning blade 92 with respect to the rotational direction of the metal roller 92C. The cleaning blade 92F is provided so that a contact portion EG which is a portion contacting the metal roller 91C does not overlap with the cleaning blade 92D as seen in a vertical direction. The cleaning blade 92F is provided for scraping off the deposited matter such as the toner passed through the cleaning blade 92D, and particularly functions effectively in the case where the toners are supplied to the cleaning blades 91D and 92D by the toner bands formed on the secondary transfer belt 12. This will be described below.

<Controller>

As shown in FIG. 1, the image forming apparatus 100 is provided with a controller (control portion) 200 and an operating portion 201.

The controller 200 is, e.g., a CPU or the like, which controls various operations of the image forming apparatus 100, and includes a memory, such as a ROM and RAM. In the memory, various programs, data, etc., for controlling the image forming apparatus 100 are stored. The operating portion 201 receives execution start instructions of various programs, such as a continuous image forming job, by a user, various data inputs by the user, and the like, and is, e.g., an external terminal such as a scanner or a personal computer, or an operating panel or the like. In this embodiment, the user is capable of providing an instruction to perform an operation in a double sided printing mode in which the image formation is effected on both surfaces of the recording material P and an operation in a single-sided printing mode in which the image formation is effected on only one surface of the recording material P, as an operation in a printing mode through the operating portion 201.

In the case where from the operating portion 201, a start instruction of the continuous image forming job in the operation in either one of the above-described printing modes is provided, the controller 200 is capable of executing an image forming process (program) stored in the memory on the basis of image data inputted from the operating portion 201. The controller 200 controls the image forming apparatus 100 on the basis of the execution of the image forming process.

Here, the continuous image forming job is performed in a period from start of image formation on the basis of a print signal for forming images continuously on a plurality of recording materials until the image forming operation is completed. Specifically, this period refers to a period from a pre-rotation (preparatory operation before the image formation) after receiving a print instruction signal to a post-rotation (operation after the image formation), and is a period including an image forming period and sheet interval (s) (during non-image formation). Incidentally, for example, in the case where after one job, another job is inputted sequentially, these jobs are discriminated as one job as a whole.

FIG. 2 shows a flowchart of the image forming process executed by the controller 200. As shown in FIG. 2, the controller 200 discriminates whether or not the double sided printing mode is instructed as the printing mode (S1). In the case where the controller 200 discriminates that the single-sided printing mode is instructed as the printing mode (NO of S1), the controller 200 executes image forming control for forming the toner image on the first surface (front surface) of the recording material P (S2). Thereafter, the process by the controller 200 goes to a process of S5. Thus, in the case of the single-sided printing mode, a toner band (FIG. 3) described later is not formed on the secondary transfer belt 12.

In the case where the controller 200 discriminated that the double sided printing mode is instructed as the printing mode (YES of S2), the controller 200 executes toner band forming control (operation in a toner supplying mode) for forming a toner band on the secondary transfer belt 12 (S3). That is, during execution of the operation in the double sided printing mode, the controller 200 controls the image forming apparatus 100 and forms the toner band on the secondary transfer belt 12 in a sheet interval between a recording material P and a subsequent recording material P. The controller 200 forms a yellow transfer high in brightness among the colors by using the image forming portion PY, and then causes the intermediary transfer belt 40 to carry the formed yellow toner band. Then, the controller 200 controls the secondary transfer high-voltage source 11, and transfers the yellow toner band from the intermediary transfer belt 40 onto the secondary transfer belt 12. Thus, the yellow toner band is formed on the secondary transfer belt 12. The toner band is a solid image formed so that, e.g., a length thereof with respect to a direction crossing the rotational direction of the secondary transfer belt 12 is not less than a width of the cleaning blades 91D and 92D with respect to a longitudinal direction and so that a length thereof with respect to the rotational direction of the secondary transfer belt 12 is, e.g., about 5 mm.

FIG. 3 shows the toner bands formed on the secondary transfer belt 12. In FIG. 3, for easy understanding of the description, the toner bands formed on the secondary transfer belt 12 are shown in a time-series manner, and for convenience, positions of the recording materials P (where the toner images are to be formed) are shown. In FIG. 3, the first surface ("1ST") represents the front surface of the recording material P, and the second surface ("2ND") represents the back surface of the recording material P.

As shown in FIG. 3, a toner band 70 is formed in a sheet interval between a recording material P and a subsequent recording material P.

Further, the toner band 70 may desirably be formed immediately in front of the recording material P in a side downstream of the recording material P with respect to the rotational direction of the secondary transfer belt 12. This is because when the toner is supplied excessively early, the toner supplied to the cleaning blade 91D is almost scraped off by the cleaning blade 91D with a lapse of time with the result that it becomes difficult that the lump of wax is not readily generated. Therefore, the toner may preferably be supplied to the cleaning blade 91D immediately before the wax formed on the recording material P reaches the cleaning blade 91D. The present invention is not limited thereto, but the toner band 70 may also be formed immediately in the rear of the recording material P in a side upstream of the recording material P with respect to the rotational direction of the secondary transfer belt 12. Further, the toner band 70 may also be formed immediately in front of and immediately in the rear of the recording material P.

Referring again to FIG. 2, the controller 200 executes the image forming control for forming the toner images sequentially on either one of the first surface (front surface) and the second surface (back surface) of the recording material P (S4). Then, the controller 200 discriminates whether or not the continuous image forming job should be ended (S5). In the case where the controller 200 discriminated that the continuous image forming job should be ended (YES of S5), the controller 200 ends the image forming process. In the case where the controller 200 discriminated that the continuous image forming job should not be ended (NO of S5), the controller causes the process to be returned to the process of S1 and then repeats the processes of S1-S5.

As described above, most of the toner band 70 formed on the secondary transfer belt 12 is moved from the fur brush 91B to the metal roller 91C and then is scraped off the metal roller 91C by the cleaning blade 91D. For that reason, only the toner in a small amount is supplied to the cleaning blade 92D of the second cleaning portion 92, with the result that the lump of wax generates at the contact portion of the cleaning blade 92D, and thus the toner is liable to pass through the cleaning blade 92D.

In view of this, in this embodiment, as shown in FIG. 1, the cleaning blade 92F contacting the metal roller 92C of the second cleaning portion 92 is provided. The cleaning blade 92F is a resin blade formed in a plate shape and is formed with, e.g., a 500 μm-thick PET sheet (resin sheet). That is, the toner reaching a position downstream of the cleaning blade 92D with respect to the rotational direction of the metal roller 92C is small in amount, and therefore there is a possibility that when a rubber blade is used as a second cleaning blade, the rubber blade is turned up. Therefore, as the cleaning blade 92F, the resin blade which is hard and which is resistant to the turning-up when compared with the rubber blade formed of the urethane rubber is used. The resin blade is inferior in toner cleaning (removing) property to the rubber blade correspondingly to a degree of hardness, but in the case of this embodiment, the amount of the toner reaching the downstream position of the cleaning blade 92D is small as described above, and therefore even the resin blade is sufficient to remove the toner. Specifically, as the first cleaning blade 92D contacted to the metal roller 92C, it is preferable that the rubber blade of less than 200 MPa in Young's modulus is used. As the second cleaning blade 92F contacted to the metal roller 92C, it is preferable that the resin blade of not less than 200 MPa in Young's modulus is used.

(Comparison Experiment)

The present inventors conducted an experiment for evaluating the cleaning performance of the secondary transfer belt cleaning device 90 by changing a combination of the rubber blade and the resin blade which are attached to the first cleaning portion 91 and the second cleaning portion 92. A result of the experiment is shown in Table 1.

TABLE 1

| | FCP*1 | SCP*2 | IC*3 | PACKING |
|---|---|---|---|---|
| COMP. EX. 1 | RU*4 | RU | YES | NO |
| COMP. EX. 2 | RE*5 | RE | YES | NO |
| COMP. EX. 3 | RU + RE | RU + RE | YES | YES |
| EMB. 1 | RU | RU + RE | NO | NO |
| EMB. 3 | RU | RE | NO | NO |

*1"FCP" is the first cleaning portion.
*2"SCP" is the second cleaning portion.
*3"IC" is the improper cleaning.
*4"RU" is the rubber blade.
*5"RE" is the resin blade.

As an experiment result of Comparison Example 1 (conventional example) in which a single rubber blade is attached to both of the first cleaning portion 91 and the second cleaning portion 92, as described above, the toner is minimally supplied to the second cleaning portion 92, so that the lump of wax is liable to generate and thus the improper cleaning in terms of the toner generates.

As an experiment result of Comparison Example 2 in which a single resin blade is attached to both of the first cleaning portion 91 and the second cleaning portion 92, the toner containing the toner band as a countermeasure against the lump of wax is supplied in a large amount, and therefore it is difficult to sufficiently scrape the toner off the metal roller by the resin blades inferior in cleaning performance of the rubber blades. For that reason, the improper cleaning in terms of the toner generates.

As an experimental result of Comparison Example 3 in which the rubber blade and the resin blade are used in combination and are attached to both of the first cleaning portion 91 and the second cleaning portion 92, the toner in a large amount is supplied to the first cleaning portion 91, and therefore the toner in the large amount is scraped off by the rubber blade at the cleaning portion 91. However, in this embodiment, for reasons of a space, the resin blade is disposed downstream of the rubber blade with respect to the rotational direction of the metal roller 91C and is disposed so that the toner scraped off by the rubber blade falls on the resin blade. Therefore, the scraped-off toner is not fed by the residual toner feeding screw 94 but is liable to cause a so-called packing such that the toner stagnates in a space between the resin blade and the rubber blade. When the packing generates, the packed toner pushes up the rubber blade from the resin blade side, so that the cleaning performance of the rubber blade lowers, and thus it is difficult to sufficiently scrape the toner off by the rubber blade. Further, the toner charged to the negative polarity and the toner charged to the positive polarity are liable to be fed toward the second cleaning portion 92 side, and of these toners, the toner charged to the negative polarity passes through the second cleaning portion 92 as-is. For that reason, the improper cleaning in terms of the toner generates. Incidentally, in order to permit feeding of the toner, scraped off by the resin blade at the first cleaning portion 91, to the residual toner box, a constitution in which a position of the feeding screw is lowered by ensuring the space between the rubber blade and the resin blade or in which the contact position of the blade is devised may be employed. However, in that case, the image forming apparatus is increased in size and cost, and therefore it is difficult to employ the constitution.

As an experimental result of Embodiment 1 in which the rubber blade (91D) is attached to the first cleaning portion 91 and the rubber blade (92D) and the resin blade (92F) are attached to the second cleaning portion 92, when the toner in a large amount is supplied to the first cleaning portion 91, the toner in the large amount is scraped off by the rubber blade (91D) at the first cleaning portion 91. Further, even when the toner passes through the rubber blade (92D) with generation of the lump of wax at the second cleaning portion 92, the amount of the toner supplied to the second cleaning portion 92 is small, and the toner is sufficiently scraped off by the resin blade (92F). For this reason, the improper cleaning in terms of the toner does not generate. In this case, at the second cleaning portion 92, the so-called packing such that the toner scraped off by the resin blade (92F) is not fed by the residual toner feeding screw 94 and stagnates can generate. However, the toner reaching the resin blade (92F) is slight in amount, and therefore the image forming apparatus can be periodically subjected to maintenance before the toner causes the improper cleaning.

As described above, in the second cleaning portion 92 to which the bias voltage of the same polarity as the charge polarity of the toner of the toner band formed on the secondary transfer belt 12 is applied, the rubber blade (92D) of less than 200 MPa in Young's modulus and the resin blade (92F) of not less than 200 MPa in Young's modulus are provided. As a result, the toner passed through the rubber blade (92D) can be scraped off by the resin blade (92F), so that the toner does not readily generate the improper cleaning. Particularly, this embodiment is particularly effective in the case where the toner in the large amount is supplied to the first cleaning portion 91 by the toner band formed on the secondary transfer belt 12 and thus the lump of wax is not readily generated.

Second Embodiment

Next, the Second Embodiment will be described. In the above-described First Embodiment, the secondary transfer belt cleaning device 90 for cleaning the secondary transfer belt 12 was described. On the other hand, the Second Embodiment is the case where an intermediary transfer belt cleaning device 45 of an electrostatic type is employed for cleaning the intermediary transfer belt 40. This will be described using FIG. 4.

Figure 4:
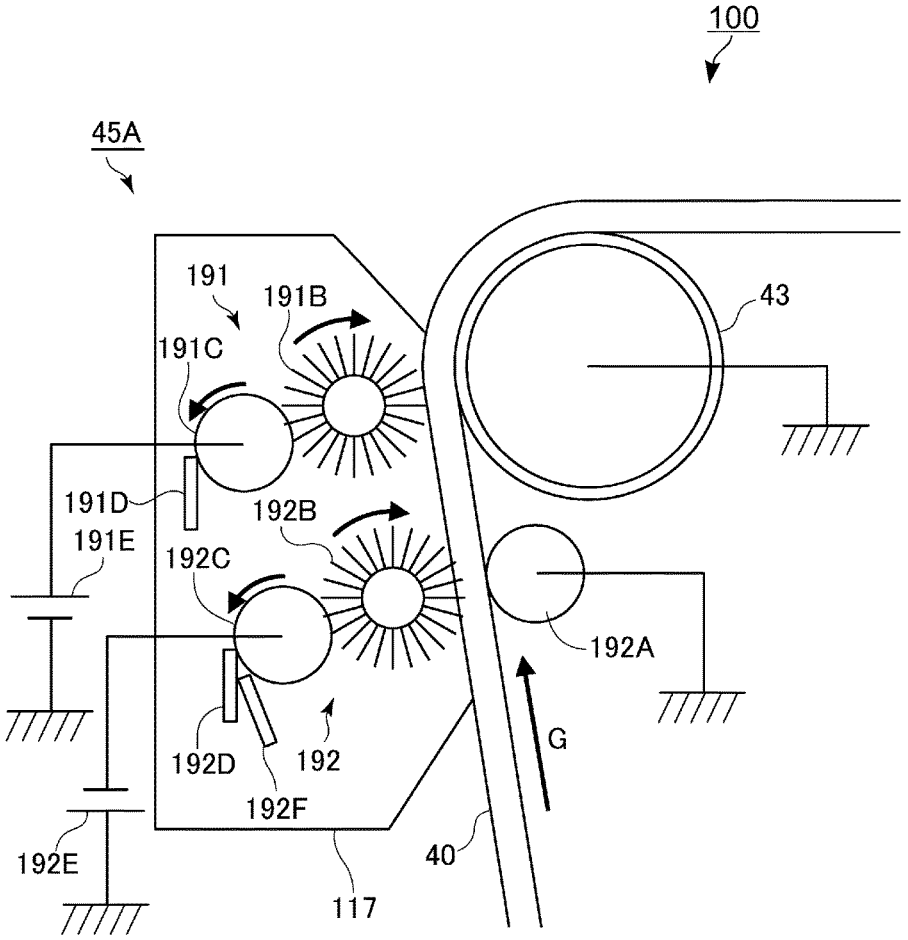
FIG. 4 is a schematic view showing an intermediary transfer belt cleaning device in a Second Embodiment.

As shown in FIG. 4, the intermediary transfer belt cleaning device 45A collects the toner charged to the positive polarity by using a fur brush 192B to which the bias voltage of the negative polarity (first polarity) is applied.

Thereafter, the toner charged to the negative polarity is collected using a fur brush 191B to which a bias voltage of the positive polarity (second polarity) is applied. In this embodiment, the fur brush 192B rubs against the intermediary transfer belt 40 in an upstream side with respect to the rotational direction of the intermediary transfer belt 40, and the fur brush 191B rubs against the intermediary transfer belt 40 in a downstream side with respect to the rotational direction of the intermediary transfer belt 40.

The intermediary transfer belt cleaning device 90 includes a first cleaning portion 191 and a second cleaning portion 192. The first cleaning portion 191 includes the fur brush 191B as a first fur brush, a metal roller 191C as a first rotatable member, a voltage (power) source 191E and a cleaning blade 191D as a first blade. The second cleaning portion 192 includes the fur brush 192B as a second fur brush, a metal roller 192C as a second rotatable member and a voltage source 192E. The second cleaning portion 192 further includes a cleaning blade 192D as a second blade and a cleaning blade 192F as a third blade. The fur brushes 191B and 192B and the metal rollers 191C and 192C are connected by an unshown gear mechanism and are rotated by an unshown driving motor. The fur brushes 191B and 192B rotate in an opposite direction to the rotational direction of the intermediary transfer belt 40 at contact positions in contacted states with the intermediary transfer belt 40, respectively, and rub against the intermediary transfer belt 40. The fur brush 191B rubs against the peripheral surface of the intermediary transfer belt 40 after the fur brush 192B rubs against the peripheral surface of the intermediary transfer belt 40. Each of these fur brushes 191B and 192B is prepared by planting electroconductive nylon fibers of $10^5$ Ω·cm in volume resistivity, and is formed in a diameter of, e.g., 18 mm. Then, the fur brush is disposed so that a penetration depth (amount) thereof into the intermediary transfer belt 40 is, e.g., 1.5 mm.

Further, the fur brushes 191B and 192B rub against the metal rollers 191C and 192C, respectively. The fur brush 191B rubs against the metal roller 191C in the contacted state with the metal roller 191C by being rotated codirectionally with the rotational direction of the metal roller 191C at the contact position. The fur brush 192B rubs against the metal roller 192C in the contacted state with the metal roller 192C by being rotated codirectionally with the rotational direction of the metal roller 192C at the contact position. Each of the metal rollers 191C and 192C is formed in a diameter of, e.g., 20 mm. Further, the metal rollers 191C and 192C are disposed so that their penetration depths into the fur brushes 191B and 192B, respectively, are, e.g., 2 mm.

A supporting roller 192A is grounded to the ground potential (0 V), and supports the intermediary transfer belt 40, against which the fur brush 192B rubs, from an inner peripheral surface side, and is rotated by the intermediary transfer belt 40. The supporting roller 192A is a cylindrical roller and is formed in a diameter of, e.g., 13 mm. The driving roller 43 is connected to the ground potential (0 V) and supports the intermediary transfer belt 40, against which the fur brush 191B rubs, from the inner peripheral surface side of the intermediary transfer belt 40, and rotationally drives the intermediary transfer belt 40 as described above. The driving roller 43 is formed in a diameter of, e.g., 25 mm by coating an outer peripheral surface thereof with, e.g., a 0.5 mm-thick electroconductive rubber of $10^5$ Ω·cm in volume resistivity.

The voltage source 192E generates an electric field between the fur brush 192B and the supporting roller 192A by applying a voltage of the negative polarity (first polarity) to the metal roller 192C. As a result, the fur brush 192B rubbing against the metal roller 192C is charged to the negative polarity and thus is capable of attracting the toner which is deposited on the intermediary transfer belt 40 and which is charged to the positive polarity. The toner attracted to the fur brush 192B is moved to the metal roller 192C higher in potential of the negative polarity, and then is scraped off by the cleaning blade 192D. The cleaning blade 192D contacts the metal roller 192C counterdirectionally to the rotational direction of the metal roller 192C and scrapes the toner off the metal roller 192C.

On the other hand, the voltage source 191E generates an electric field between the fur brush 191B and the driving roller 43 by applying a voltage of the positive polarity (second polarity) to the metal roller 191C. As a result, the fur brush 191B rubbing against the metal roller 191C is charged to the positive polarity and thus is capable of attracting the toner which is deposited on the intermediary transfer belt 40 and which is charged to the negative polarity. The toner attracted to the fur brush 191B is moved to the metal roller 191C higher in potential of the positive polarity, and then is scraped off by the cleaning blade 191D. The cleaning blade 191D contacts the metal roller 191C counterdirectionally to the rotational direction of the metal roller 191C and scrapes the toner off the metal roller 191C. These cleaning blades 191D and 192D are rubber blades formed in a plate shape. As the cleaning blades 191D and 192D, a urethane rubber-made rubber blade of less than 200 MPa in Young's modulus and about 60-90, preferably about 70-80, in Asker-C hardness may preferably be used.

Onto the intermediary transfer belt 40, the wax is not moved directly from the recording material P but can be moved and deposited via the secondary transfer belt 12. Further, the cleaning blades 191D and 192D are also capable of scraping the waxes deposited on the metal rollers 191C and 192C via the fur brushes 191B and 192B. However, the waxes which are not scraped off and which passed through the cleaning blades are liable to accumulate and deposit at contact portions of the cleaning blades 191D and 192D and when heights of the accumulated waxes reach a height at which the toners are capable of passing through the cleaning blades, the improper cleaning (removal) of the toners can generate. Therefore, in this embodiment, as described later, toner bands are formed on the first transfer belt 40, so that the toners are supplied to the cleaning blades 191D and 192D via the fur brushes 191B and 192B and the metal rollers 191C and 192C. By supplying the toners, lumps of waxes are prevented from generating at the contact portions of the cleaning blades 191D and 192D.

However, in the case of the above-described intermediary transfer belt cleaning device 45A, most of the toner bands formed on the intermediary transfer belt 40 pass through the second cleaning portion 192 and are supplied to the first cleaning portion 191. For that reason, the lump of wax generates at the contact portion of the cleaning blade 192D, so that the toner is liable to pass through the cleaning blade 192D.

Therefore, with respect to the metal roller 192C of the second cleaning portion 192, a second cleaning blade 192F is provided downstream of the cleaning blade 192 with respect to the rotational direction of the metal roller 192C. The cleaning blade 192F is provided for scraping off the toner passed through the cleaning blade 192D, and particularly functions effectively in the case where the toners are supplied to the cleaning blades 191D and 192D by the toner bands formed on the intermediary transfer belt 40. The cleaning blade 192F is a resin blade formed in a plate shape and is formed with, e.g., a 500 μm-thick PET sheet (resin sheet). In this case, the toner reaching a position downstream of the cleaning blade 192D with respect to the rotational direction of the metal roller 192C is small in amount, and therefore there is a possibility that when a rubber blade is used as a second cleaning blade, the rubber blade is turned up. Therefore, as the cleaning blade 192F, the resin blade which is hard and which is resistant to the turning-up when compared with the rubber blade formed of the urethane rubber is used. The resin blade is inferior in toner cleaning (removing) property to the rubber blade correspondingly to a degree of hardness, but in the case of this embodiment, the amount of the toner reaching the downstream position of the cleaning blade 192D is small as described above, and therefore even the resin blade is sufficient to remove the toner. Specifically, as the first cleaning blade 192D contacted to the metal roller 192C, it is preferable that the rubber blade of less than 200 MPa in Young's modulus is used. As the second cleaning blade 192F contacted to the metal roller 192C, it is preferable that the resin blade of not less than 200 MPa in Young's modulus is used.

As described above, even in the case of the intermediary transfer belt cleaning device 45A, similarly as in the case of the above-described secondary transfer belt cleaning device 90, the toner does not readily cause the improper cleaning. That is, in the second cleaning portion 192 to which the bias voltage of the same polarity as the charge polarity of the toner of the toner band formed on the intermediary transfer belt 40 is applied, the rubber blade (192D) of less than 200 MPa in Young's modulus and the resin blade (192F) of not less than 200 MPa in Young's modulus are provided. As a result, the toner passed through the rubber blade (192D) can be scraped off by the resin blade (192F), so that the toner does not readily generate the improper cleaning. Particularly, this embodiment is particularly effective in the case where the toner in the large amount is supplied to the first cleaning portion 191 by the toner band formed on the intermediary transfer belt 40 and thus the lump of wax is not readily generated.

Third Embodiment

Figure 5:
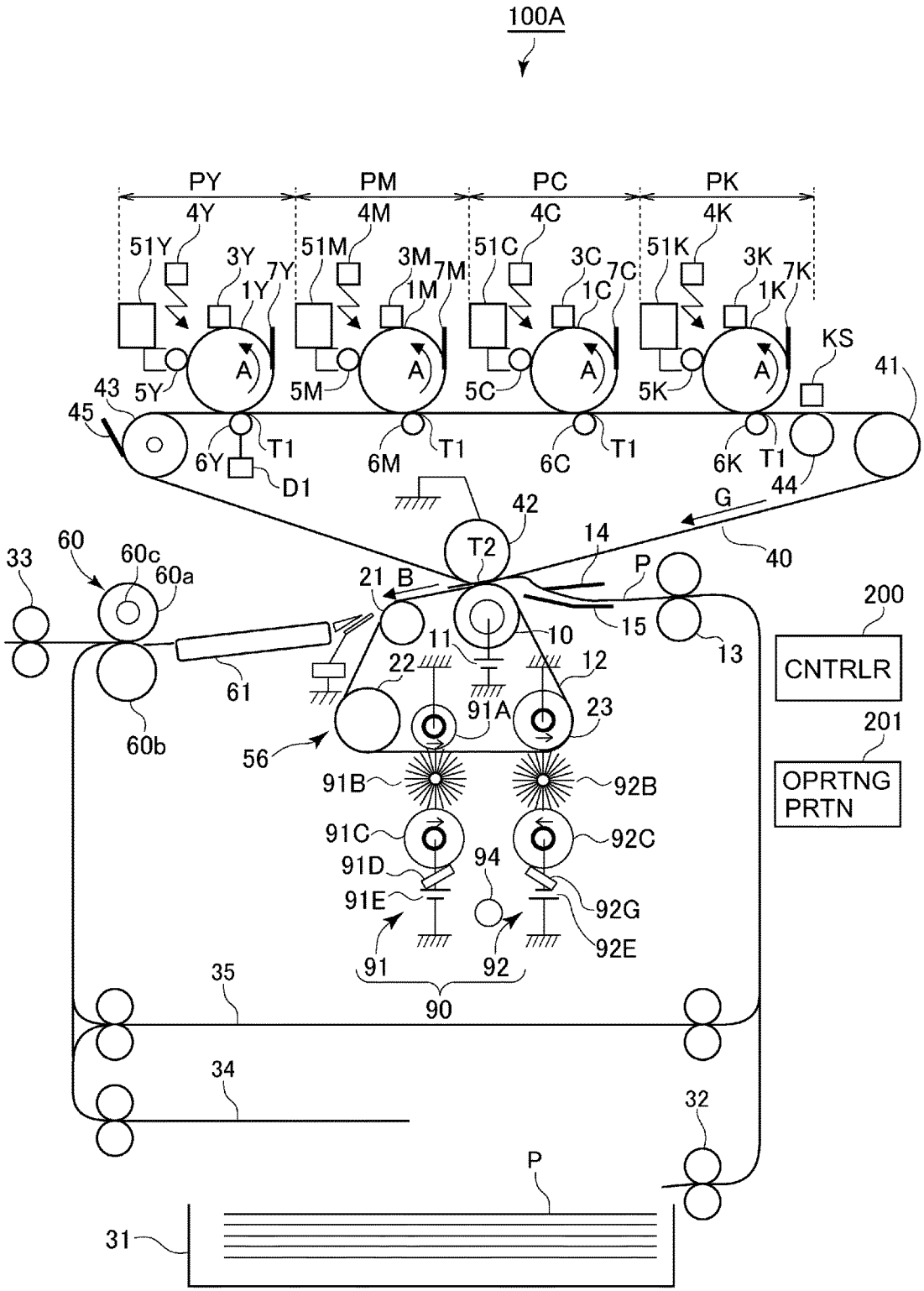
FIG. 5 is a schematic view showing an image forming apparatus in a third Embodiment.

In FIG. 5, an image forming apparatus 100A in the Third Embodiment is shown. As shown in FIG. 5, the image forming apparatus 100A is different from the image forming apparatus 100 in the above-described First Embodiment in that a single cleaning blade 92G is contacted to the metal roller 92C, and other constitutions are the same as those in the image forming apparatus 100. The constitutions which are the same as those in the image forming apparatus 100 are represented by the same reference numerals or symbols and will be omitted from description thereof.

The present inventors have confirmed from an experiment or the like that the lump of wax generating at the contact portion does not readily become larger in the case of the resin blade than in the case of the rubber blade and that growth of the lump of wax is slower in the case of the resin blade than in the case of the rubber blade. This is because the resin blade is harder than the rubber blade and therefore a range of the contact portion thereof is narrower than that of the rubber blade. For example, the range of the contact portion of the rubber blade was 15 μm, whereas the range of the contact portion of the resin blade was 3 μm. That is, in the case where contact pressures of these blades are made the same, a pressure of the resin blade at the contact portion is 5 times larger than a pressure of the rubber blade at the contact portion. In other words, it would be considered that the resin blade suppresses the growth of the deposited wax in a direction of pushing up the blade with a force which is 5 times larger than a force of the rubber blade. Accordingly, using the resin blade, it is possible to prolong a period until the improper cleaning due to the lump of wax generates. Therefore, in this embodiment, as the cleaning blade 92G, the resin blade of not less than 200 MPa in Young's modulus was used. The cleaning blade 92G is disposed at the same position as the position of the cleaning blade 92D of the secondary transfer belt cleaning device 90 shown in FIG. 1.

In this case, most of the toner on the secondary transfer belt 12 is scraped off by the first cleaning portion 91 where the polarity is opposite to the charge polarity of the toner, and therefore the amount of the toner reaching the cleaning blade 92G is very small. Further, as already described above, using the resin blade, the growth of the lump of wax is made slower than that in the case of the rubber blade, and therefore periodical maintenance is effected before the improper cleaning due to the lump of wax generates, so that the improper cleaning did not generate (Third Embodiment in Table 1).

Other Embodiments

In the above-described First to Third Embodiments, the belt-shaped rotatable secondary transfer member (secondary transfer belt) was used, but the rotatable secondary transfer member is not limited thereto and may also have a cylindrical shape (drum shape).

With respect to the rotational direction of the secondary transfer belt 12, the first cleaning portion 91 having the opposite polarity to the charge polarity of the toner is disposed on the upstream side, and the second cleaning portion 92 having the same polarity as the charge polarity of the toner is disposed in the downstream side. However, the present invention is not limited thereto. With respect to the rotational direction of the secondary transfer belt 12, a cleaning portion having the same polarity as the charge polarity of the toner may also be disposed in the upstream side, and a cleaning portion having the opposite polarity to the charge polarity of the toner may also be disposed in the downstream side.

Incidentally, in the above-described First to Third Embodiments, the image forming apparatus was described using the full-color printer as an example. However, the present invention is not limited thereto, but is applicable to any image forming apparatus as long as the apparatus effects the secondary transfer by using the intermediary transfer member. The present invention can be carried out by the image forming apparatus effecting the secondary transfer by using the intermediary transfer member, regardless of whether the apparatus is of tandem type, single drum type, the charging type, the electrophotographic image forming type, the developing type, the transfer type, and the fixing type. Examples of such image forming apparatuses may include printers, various printing machines, copying machines, facsimile machines, multifunction (image forming) machines, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-133807 filed on Jul. 2, 2015, which is hereby incorporated by reference herein in its entirety.

What is claimed is:

1. An image forming apparatus comprising:

a movable intermediary transfer member;

a toner image forming unit configured to form a toner image on said intermediary transfer member with a toner containing a wax;

a voltage source configured to output a voltage;

a rotatable transfer member configured to form a transfer portion in contact with said intermediary transfer member, wherein in the transfer portion, a transfer electric field is formed by said voltage source for transferring the toner image from said intermediary transfer member onto a recording material fed to the transfer portion;

a fixing unit configured to fix the toner image on the recording material by heating the recording material, on which the toner image is transferred, together with the toner image at the transfer portion;

a feeding portion configured to feed to the transfer portion the recording material after passing through said fixing unit, wherein said feeding unit feeds the recording material so that a toner image-fixed surface of the recording material faces toward said rotatable transfer member at the transfer portion;

an executing portion configured to execute double-sided image formation for forming the toner image on one surface of the recording material and then for forming a toner image on the other surface of the recording material by feeding the recording material by said feeding portion; and first and second cleaning units configured to electrostatically remove the toner on said rotatable transfer member, wherein said first cleaning unit includes a first brush roller, a first rotatable member and a first blade member, wherein said second cleaning unit includes a second brush roller, a second rotatable member, a second blade member and a third blade member, wherein each of said first and second brush rollers has electroconductivity and electrostatically attracts the toner on said rotatable transfer member in contact with said rotatable transfer member while being rotated, wherein a voltage of an opposite polarity to a normal charge polarity of the toner is applied to said first rotatable member, and the toner attracted to said first brush roller in contact with said first brush roller is electrostatically attracted to said first rotatable member, wherein a voltage of an identical polarity to the normal charge polarity of the toner is applied to said second rotatable member, and the toner attracted to the second brush roller in contact with said second brush roller at a contact position is electrostatically attracted to said second rotatable member, wherein said first blade member contacts said first rotatable member and scrapes a deposited matter off said first rotatable member with rotation of said first rotatable member, wherein said second blade member contacts said second rotatable member at a cleaning portion and scrapes a deposited matter off said second rotatable member with rotation of said second rotatable member, and wherein said third blade member is disposed downstream of the cleaning portion and upstream of the contact position with respect to a rotational direction of said second rotatable member, and scrapes the deposited matter off said second rotatable member with the rotation of said second rotatable member.

2. An image forming apparatus according to claim 1, wherein Young's modulus of said third blade member at a portion contacting said second rotatable member is larger than that of said second blade member.

3. An image forming apparatus according to claim 1, wherein said executing portion executes an operation in a toner supplying mode in which during execution of the double sided image formation, a predetermined supply toner image is formed on said intermediary transfer member and is transferred onto said rotatable transfer member and thus toners are supplied to said first, second and third blade members.

4. An image forming apparatus according to claim 1, wherein said second brush roller is disposed downstream of said first brush roller and upstream of the transfer portion with respect to a rotational direction of said rotatable transfer member.

5. An image forming apparatus according to claim 1, wherein as seen in a vertical direction, a portion where said third blade member contacts said second rotatable member is disposed so as not to overlap with said second blade member.

6. An image forming apparatus comprising:

a movable intermediary transfer member;

a toner image forming unit configured to form a toner image on said intermediary transfer member with a toner containing a wax;

a voltage source configured to output a voltage;

a rotatable transfer member configured to form a transfer portion in contact with said intermediary transfer member, wherein in the transfer portion, a transfer electric field is formed by said voltage source for transferring the toner image from said intermediary transfer member onto a recording material fed to the transfer portion;

a fixing unit configured to fix the toner image on the recording material by heating the recording material, on which the toner image is transferred, together with the toner image at the transfer portion;

a feeding portion configured to feed to the transfer portion the recording material after passing through said fixing unit, wherein said feeding unit feeds the recording material so that a toner image-fixed surface of the recording material faces toward said rotatable transfer member at the transfer portion;

an executing portion configured to execute double-sided image formation for forming the toner image on one surface of the recording material and then for forming a toner image on the other surface of the recording material by feeding the recording material by said feeding portion; and first and second cleaning units configured to electrostatically remove the toner on said rotatable transfer member, wherein said first cleaning unit includes a first brush roller, a first rotatable member and a first blade member, wherein said second cleaning unit includes a second brush roller, a second rotatable member, a second blade member and a third blade member, wherein each of said first and second brush rollers has electroconductivity and electrostatically attracts the toner on said intermediary transfer member in contact with said intermediary transfer member while being rotated, wherein a voltage of an opposite polarity to a normal charge polarity of the toner is applied to said first rotatable member, and the toner attracted to said first brush roller in contact with said first brush roller is electrostatically attracted to said first rotatable member, wherein a voltage of an identical polarity to the normal charge polarity of the toner is applied to said second rotatable member, and the toner attracted to the second brush roller in contact with said second brush roller at a contact position is electrostatically attracted to said second rotatable member, wherein said first blade member contacts said first rotatable member and scrapes a deposited matter off said first rotatable member with rotation of said first rotatable member, wherein said second blade member contacts said second rotatable member at a cleaning portion and scrapes a deposited matter off said second rotatable member with rotation of said second rotatable member, and wherein said third blade member is disposed downstream of the cleaning portion and upstream of the contact position with respect to a rotational direction of said second rotatable member, and scrapes the deposited matter off said second rotatable member with the rotation of said second rotatable member.

7. An image forming apparatus according to claim 6, wherein Young's modulus of said third blade member at a portion contacting said second rotatable member is larger than that of said second blade member.

8. An image forming apparatus according to claim 6, wherein said executing portion executes an operation in a toner supplying mode in which during execution of the double sided image formation, a predetermined supply toner image is formed on said intermediary transfer member and is passed through the transfer portion by applying an electric field opposite in direction to the transfer electric field to said transfer portion and thus toners are supplied to said first, second and third blade members.

9. An image forming apparatus according to claim 6, wherein said second brush roller is disposed upstream of said first brush roller and downstream of the transfer portion with respect to a rotational direction of said intermediary transfer member.

* * * * *